United States Patent [19]

D'Oporto et al.

[11] 4,211,127

[45] Jul. 8, 1980

[54] RATCHET WRENCH REVERSING MECHANISM

[75] Inventors: Tito R. D'Oporto, Costa Mesa; Delo K. K. Chun, Mission Viejo, both of Calif.

[73] Assignee: Ingersoll-Rand Company, Woodcliff Lake, N.J.

[21] Appl. No.: 4,693

[22] Filed: Jan. 19, 1979

[51] Int. Cl.[3] ..... B25B 13/46

[52] U.S. Cl. ..... 81/63; 81/177 G

[58] Field of Search ..... 81/60–63.2, 81/177 G; 192/43.1

[56] References Cited

U.S. PATENT DOCUMENTS

| | | | |
|---|---|---|---|
| 2,107,568 | 2/1938 | Haist | 81/62 |
| 2,712,256 | 7/1955 | Fish | 81/62 |
| 3,208,318 | 9/1965 | Roberts | 81/177 G |
| 3,508,456 | 4/1970 | Schultz | 81/62 |
| 3,713,356 | 1/1973 | Knudsen | 81/62 |

*Primary Examiner*—James L. Jones, Jr.

*Attorney, Agent, or Firm*—Walter C. Vliet

[57] ABSTRACT

A ratchet wrench reversing mechanism which utilizes a finger spring to contact the reversing pawl. The finger spring is attached to or constrained by the reversing knob and is in concentric relationship with a central stem which effects socket release.

8 Claims, 8 Drawing Figures

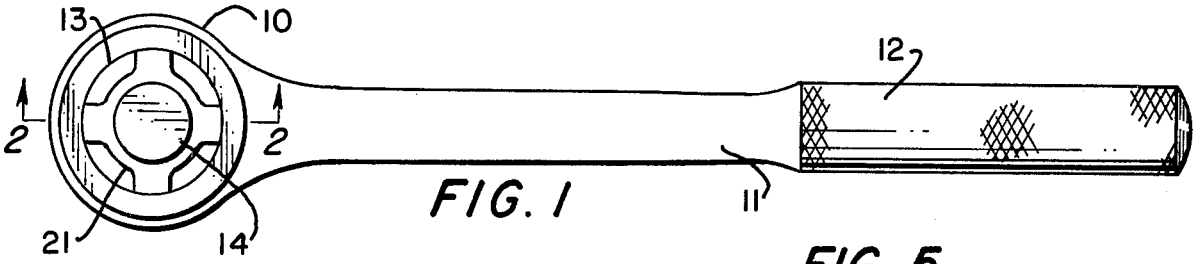
FIG. 1
FIG. 5
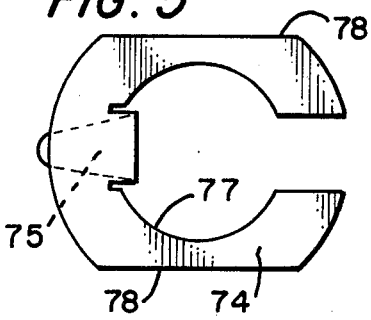
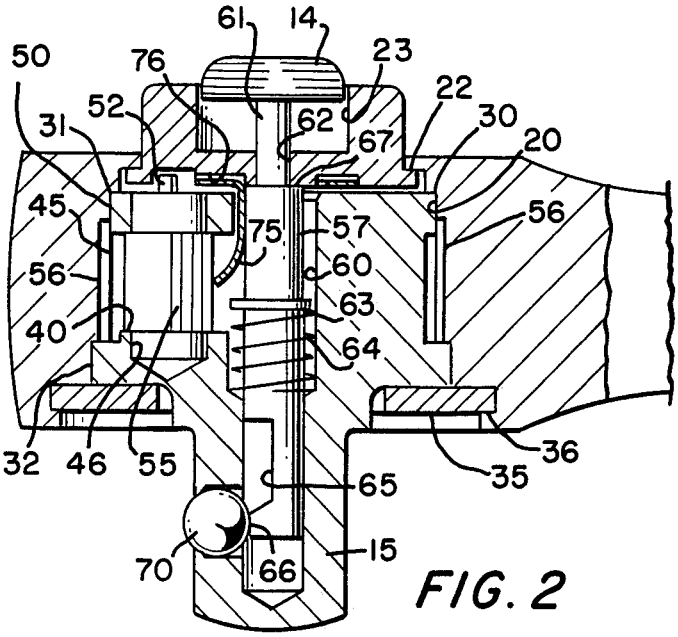
FIG. 2
FIG. 6
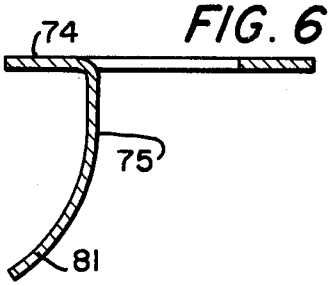
FIG. 7
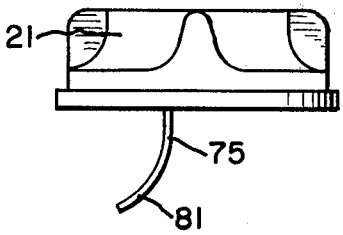
FIG. 3
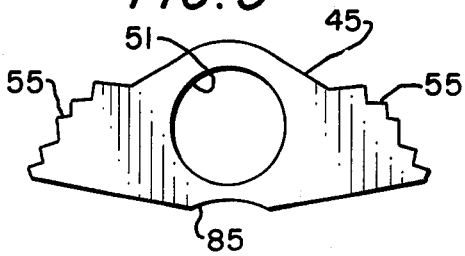
FIG. 8
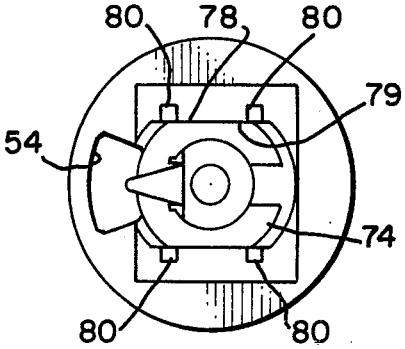
FIG. 4
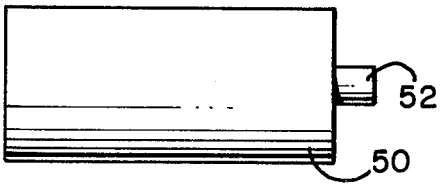

RATCHET WRENCH REVERSING MECHANISM

BACKGROUND OF THE INVENTION

In recent years a number of reversing ratchet wrench mechanisms have been developed which further include a device allowing ready release of a socket. These are known as the so called push button release ratchet wrenches. Typical designs of these are shown in patents issued to Roberts, U.S. Pat. No. 3,208,318, Jolliff, U.S. Pat. No. 3,393,587, and Hasnar, U.S. Pat. No. 3,532,013. The present invention is an improvement of the so called push button release ratchet wrench.

OBJECT OF THE INVENTION

The object of the present invention is to provide a simple, reliable, economical, and easy to use push button release ratchet wrench.

A particular object of the present invention is to provide an improved device for moving the reversing pawl and maintaining it in contact with the meshing teeth of the wrench body.

A further object of the present invention is to provide a push botton release mechanism which is simple, reliable, and easy to use and whose action is independent of the action of the reversing knob.

A further object of the present invention is the reduction in the number of associated parts required to accomplish both the reversing action of the ratchet and socket release.

These and other objects are obtained in a ratchet wrench comprising: a body having a core member rotatable therein; cooperating ratchet means carried by the body and the core member and relatively adjustable to effect selectively clockwise and counter clockwise rotation of the core member in relation to the body to thereby accommodate the wrench to tightening and loosening of a threaded fastener of the like; coupling means attached to the core member for releasably securing said drive means to the coupling means; a reversing knob operatively associated with the ratchet means to effect its relative adjustment; the reversing knob being independent in operation of the release means; and finger spring means attached to the reversing knob for adjusting the ratchet means by rotation of the reversing knob.

BRIEF DESCRIPTION OF THE DRAWINGS

FIG. 1 is a plan view of a ratchet wrench incorporating the present invention;

FIG. 2 is a cross sectional elevation view of a portion of the head of the ratchet taken at Section 2—2 of FIG. 1;

FIG. 3 is a detailed plan view of the reversing ratchet cog;

FIG. 4 is a side elevation view of the pivot pin for for the reversing ratchet cog;

FIG. 5 is a detailed plan view of the reversing ratchet spring;

FIG. 6 is a cross sectional side elevation view of the reversing spring;

FIG. 7 is a side elevation view of the reversing knob with the reversing spring attached; and FIG. 8 is a bottom plan view of the reversing knob showing the reversing spring attachment.

DESCRIPTION OF PREFERRED EMBODIMENT

Referring to FIG. 1 a conventional round head ratchet wrench is shown having a head portion 10, a shank portion 11, and knurled handle portion 12.

Wrenches of this type are commonly provided with a knob 13 for accomplishing the reversing of the ratchet wrench. The present invention is also provided with a push button 14 for releasably securing a conventional socket to the commonly provided square drive output 15, best seen in FIG. 2.

FIG. 2 is an elevation cross section view taken through the head portion of the ratchet wrench at Section 2—2 on FIG. 1. FIG. 1 shows the principle components of the reversing ratchet mechanism.

The head is provided with a through bore 20, which is progressively stepped to a smaller diameter from top to bottom to accommodate the ratchet release components.

A disc shaped knob 13 is shown inserted in the top portion of the head. The upper portion of the reversing knob is provided with 4 spaced recesses 21 which provide a convenient grip for rotating the reversing knob about its vertical axis. The reversing knob is also provided with a lip flange 22 which serves to retain the reversing knob in the through bore 20. In addition, the reversing knob is provided with a counter bore 23 which provides suitable recesses into which the push button 14 may be depressed.

Also inserted in the through bore just below the reversing knob is a core member 30 which is rotatably disposed in the through bore for rotation about its vertical axis. The core member 30 is provided with an upper flange 31 and a lower flange 32. Flange 31 and 32 provide the required bearing surface for rotation and further prevent the core member from moving vertically upward in the through bore. A retaining ring 35 is disposed in a ring groove 36 and serves to retain the core member in the through bore by preventing its vertically downward movement.

The core member is provided with a segment cut 40 which extends for nearly one half of the diameter of the core member and which is wide enough to slidingly receive a reversing ratchet cog 45. A portion of the core member above and below the segment cut serves to align the reversing ratchet cog.

A bore 46 extending vertically through the segment cut portion of the core member receives a pivot pin 50. The pivot pin 50 further disposed through a center bore 51 of the reversing ratchet cog as shown on FIG. 3 and serves to secure the reversing ratchet cog and allow it to rock about its vertical axis in the segment cut.

The pivot pin is further provided with a stop projection 52, which is conveniently cylinderical. The stop 52 projects into a recess 54 in the reversing knob best seen on FIG. 8 and FIG. 2 and serves to limit the rotation of the reversing knob. The reversing ratchet cog is provided with gripping teeth 55 at both of its extreme ends.

The center to tip gripping teeth diameter is such that when the reversing ratchet cog is centrally aligned in the segment cut the teeth do not interact with the through bore 20. However, as can be appreciated by one skilled in the art, if the reverse ratchet cog is sufficiently rotated about the pivot pin it will cause engagement of the gripping teeth 55 with corresponding bore teeth 56 which are provided in through bore 20 as shown in FIG. 2. Depending on the direction of the offset, the core member may be rotated either clockwise or counter clockwise relative to the ratchet wrench head. This is a conventional means of accomplishing the reversing ratchet function of a typical round headed ratchet wrench and can best be seen in FIG. 2.

The core member 30 is further provided with a stepped center bore 60 which receives a release shaft 57. The release shaft 57 is connected to the push button 14 by means of a slightly reduced diameter area 61 which passes through a bore 62 in the reversing knob 13. The collar 67 formed at the reduced diameter serves to limit the vertically upward movement of the release shaft. In addition, the release shaft is provided with a boss collar 63 which corporates with a coil force spring 64 to impart a vertically upward force to the release shaft.

The release shaft at its lower end is provided with a segment cut 65 which provides a recess for a lock ball 70 to retract into when the push button 14 is depressed. The release shaft 57 is also provided with land 66 at its extremely lower end. The land serves to retain the lock ball in its outer most locking position.

As can be appreciated by one skilled in the art, to place a socket on the square drive 15 of the core member, it is necessary to depress the push button to allow the lock ball to retract into the segment cut recess 65.

Once the socket has been inserted on the square drive, the push button is released and the lock ball is pushed out into its extended locking position by land 66. This land also securely holds the ball in place and, therefore, the socket in place during normal operation. To release the socket, it is necessary to again depress the push button 14.

As previously mentioned, the reversing knob accomplishes reversing of the ratchet wrench by displacing the reversing cog 45. A unique finger spring 75 is provided to accomplish this action. As can be seen in FIG. 5 and 6, the spring is provided with a horizontal base portion which is secured to the reversing knob in a recess 76. The horizontal base portion 74 is provided with a cut out portion 77 which allows it to be disposed about the release shaft. The horizontal base portion is further provided with a flat 78 on each side. The flat 78 cooperates with the side 79 of the recess 76 to prevent rotation of the reversing spring when it is in the recess.

To retain the spring in the recess, the edges of the flat side 79 are upset at points 80 thereby effectively stakeing the spring to the reversing knob. The finger portion of the spring 81 forms a slightly bent flat spring which bears against the control surface 85 of the reverse ratchet cog, as best seen on FIG. 3.

In place the finger creates a force on the control surface 85 which pushes to the left as shown on FIG. 2. This force depending on its point of contact on surface 85 creates the rocking action of the reversing ratchet cog required to reverse the ratchet mechanism. In addition, it serves to give a positive feel to the reversing knob.

The combination of the coil force spring 64 and the finger spring 81 force must be carefully chosen to provide the proper reversing force and reversing knob feel in combination with an appropriate push button force. Excessive finger spring force 81 will cause the reversing knob to tilt and excessive coil spring force will make the push button difficult to depress.

When the forces are properly balanced, a reliable, smooth, push button release and reversing knob action is obtained in an economical reversing mechanism. The simplicity of the mechanism and its ability to accommodate substantial quantities of foreign matter without losing its operation characteristics make it ideally suited for a reversing ratchet wrench mechanism.

While we have described an embodiment of the invention, it should be obvious to one skilled in the art that several modifications are possible within the scope of the invention. For example, a reversing ratchet cog may be provided on each side of the release shaft. The reversing finger spring would then be provided with two opposed fingers 81, which would simultaneously operate the reversing mechanism and provide a balance force on the reversing spring. This would be a very suitable but more expensive alternative to the embodiment shown.

Other means of securing or attaching the finger spring to the reversing knob and preventing rotation of the spring related to the knob may be utilized. For example, the horizontal base portion may be bowed and forced into the recess 76. The flats 78 may be eliminated if a key is provided in recess 76. The key could mate with the cut-out portion 77 as one convenient means.

Applicants do not wish to be limited in the scope of the invention except as claimed.

I claim:

1. A ratchet wrench comprising:

a body having a core member rotatable therein;

cooperating ratchet means carried by said body and said core member and relatively adjustable to effect selectively clockwise and counterclockwise rotation of said core member in relation to said body to thereby accommodate the wrench to tightening and loosening of a threaded fastener or the like;

coupling means attached to said core member for releasably securing a drive means for a threaded fastener;

push button means extending through said core member for releasably securing a drive means to said coupling means;

a reversing knob operatively associated with said ratchet means to effect its relative adjustment;

said reversing knob being independent in operation of said release means;

a finger spring operated by said reversing knob for adjusting said ratchet means by rotation of said reversing knob;

said push button release means further comprises a push button disposed in a pocket of said reversing knob;

said push button is attached to a shaft which extends through said reversing knob and said core member and operatively contacts said ball retention member; and said push button and said shaft are free to reciprocate in said reversing knob and said core member and said coupling means and said push button and said shaft are further free to rotate in said reversing knob and said core member.

2. A ratchet wrench according to claim 1 wherein:

said core member is provided with a rocking ratchet lug having ratchet teeth which cooperate with corresponding ratchet teeth in said body surrounding said core member.

3. A ratchet wrench according to claim 1 wherein:

said coupling means is a socket square drive having a ball retention member disposed on at least one of the sides of the square drive and said ball is reciprocally mounted for movement from an extended position wherein it engages a drive socket to a retracted position wherein said socket is free to disassociate itself from said square drive member.

4. A ratchet wrench according to claim 3 wherein:

said push button release means further comprises a disc shaped button disposed in said pocket of said reversing knob. pg,13

5. A ratchet wrench according to claim 4 wherein:

said shaft means is spring biased in the direction of said push button whereby said ball retention member is forced to its extended position.

6. A ratchet wrench according to claim 2 wherein:

said reversing knob is mounted within said body towards one end of said core member and is free to rotate relative to said core member about an axis formed by said push button release means; and said push button release means is provided with a finger spring which will selectively bias said reversing ratchet lug to accomplish reversing of the ratchet wrench.

7. A ratchet wrench according to claim 6 wherein:

said finger spring is formed in a plane perpendicular to a mounting base portion of said finger spring attached to said reversing knob.

8. A ratchet wrench according to claim 6 wherein:

said reversing ratchet lug is mounted to said core member on a mounting pin; and said mounting pin further serves to limit the extent of rotation between said reversing knob and said core member.

* * * * *